United States Patent [19]

Flosi et al.

[11] Patent Number: 4,590,621

[45] Date of Patent: May 27, 1986

[54] CHEST PROTECTOR

[76] Inventors: Corrado Flosi, Via Rosselli 8, San Romano; Roberto Maccioni, Via Vittor Pisani 37, Viareggio, both of Italy

[21] Appl. No.: 730,459

[22] Filed: May 6, 1985

[51] Int. Cl.[4] ..... A41D 13/00

[52] U.S. Cl. ..... 2/2

[58] Field of Search ..... 2/2

[56] References Cited

U.S. PATENT DOCUMENTS

| | | | |
|---|---|---|---|
| 3,867,726 | 2/1975 | Owl et al. | 2/2 |
| 4,135,252 | 1/1979 | Latina et al. | 2/2 |
| 4,320,537 | 3/1982 | Mitchell | 2/2 |
| 4,435,851 | 3/1984 | Mitchell et al. | 2/2 |
| 4,467,475 | 8/1984 | Gregory et al. | 2/2 |

*Primary Examiner*—Louis K. Rimrodt

*Attorney, Agent, or Firm*—Ralph S. Branscomb

[57] ABSTRACT

An upper body chest protector is provided for use particularly in off-road motorcycle and bicycle racing which features spring-biased epaulets, so that as the upper arm is raised, the respective epaulet will be raised against the spring bias to permit movement of the upper arm, but upon lowering of the arm, the epaulet is forced down into its lowered position to assure that the shoulder will be protected thereby after the upper arm is lowered.

10 Claims, 5 Drawing Figures

FIG. 1
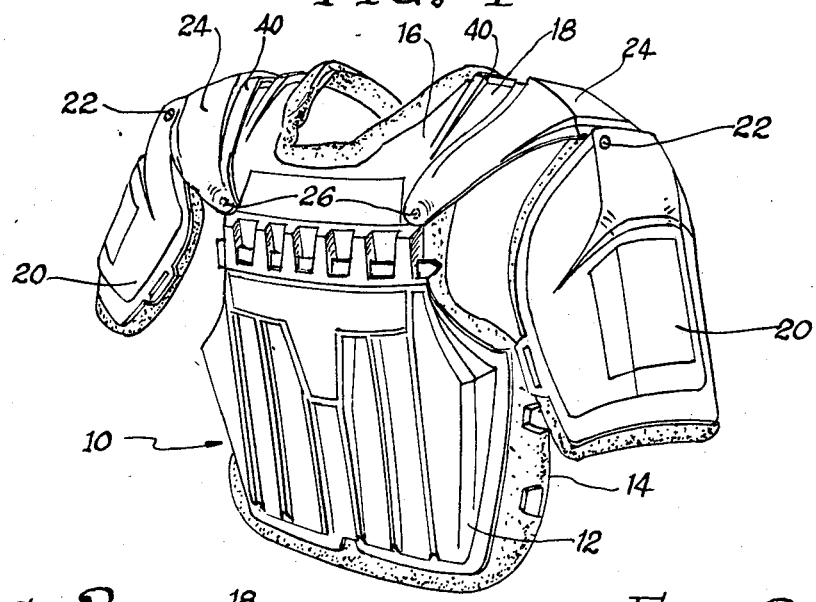
FIG. 2
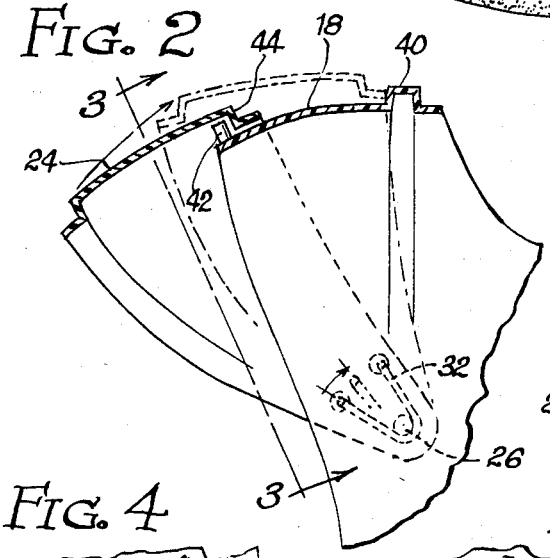
FIG. 3
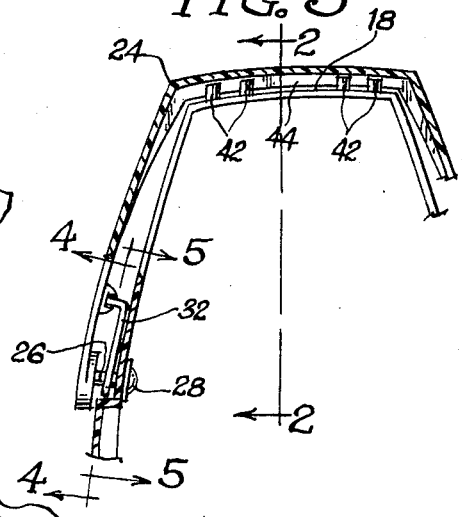
FIG. 4
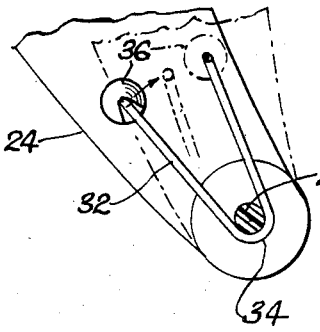
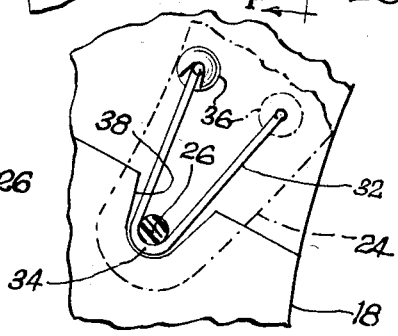
FIG. 5

CHEST PROTECTOR

BACKGROUND OF THE INVENTION

The popularity of motocross, off-road racing and just off-road riding has greatly increased in the last decade and has brought with it an increasingly sophisticated line of protective equipment. There are now upper torso and arm protectors that are very commonly used, and are very lightweight, tough and durable. They are made of plastic, and in the state of the art are lined on the inside and the tough plastic exoskeleton is provided with a multiplicity of relatively closely spaced slots, both to reduce the weight of the armour, but primarily to permit ventilation and the evaporation of sweat, inasmuch as off-road racing and riding is often done in warm conditions.

There are naturally continuing design feature conflicts to be considered in the protectors, such as weight versus effectiveness, quality of materials versus exposure, and so forth. One such conflicting consideration is the flexibility of the protector versus its effectiveness. Obviously, the most flexible protector would be something the nature of a long sleeved t-shirt, which offers none of the desired protection at all. The upper body portion must provide as much rigidity as possible to prevent against gauging and puncture injuries from stones, branches and rocks, especially when the rider falls.

The conflicts between flexibility in use and rigid protection against such injuries becomes apparent when considering the design of the shoulder area of the state-of-the art protectors. It is desirable to protect the shoulder somewhat beyond the shoulder articulation. However, to do so would limit the ability of the arm to move upward, and could conceivably even cause injury to the upper arm if, during a fall, it were forced upwardly against a rigid shoulder protector. This conflict has lead to the development of a pivotal shoulder protector, commonly called an epaulet. Typically, these epaulets are free to pivot up out of the way when the upper arm is raised. When the arm is lowered, some models have a strap connected to an upper arm piece which pulls the epaulet back down in position. Although gravity might accomplish this, the epaulet pivots primarily horizontally, and it would be questionable whenever it would come back into position without the strap.

However, the upper arm protector already has one strap in most models which connect it to the main body of the torso protector, so that the second strap between the upper arm protector and the epaulet merely adds to the problem and dangers inherent in straps, i.e., snagging on passing branches, breaking, and even the fact that they look somewhat tattered as they are exposed. There is a need for an effective means of insuring that the epaulet returns to its lowered position, but a means which is protected from passing brush, is out of sight, and is virtually fool-proof.

SUMMARY OF THE INVENTION

The instant invention provides such a means in a form of a spring-loaded epaulet which is gently biased into the lowered position in which it gives adequate protection to the shoulder, but which can be pushed upwardly by the arm with very little effort when the arm is raised. The spring is in the form of a hairpin-spring, one being used for each epaulet, and it is captured between the pivotal area of the epaulet itself, and the underlying portion of the protector or shield to which the epaulet pivots.

In addition to being safer and more reliable, the action is also considerably better inasmuch as with the strap, after the arm has been raised, it must be lowered all the way down before the strap will jerk the epaulet into position, whereas with a spring-bias, there is a continual following action of the epaulet on the upper arm and shoulder so that maximum shielding and protection of the shoulder articulation is achieved at all times.

BRIEF DESCRIPTION OF THE DRAWINGS

FIG. 1 is a front perspective view of an upper body protector showing the epaulets in place;

FIG. 2 is a lateral section through the shoulder piece and epaulet illustrating the spring in phantom and the lower position stops;

FIG. 3 is a section along line 3—3 of FIG. 2;

FIG. 4 is a section along line 4—4 of FIG. 3; and,

FIG. 5 is a section along line 5—5 of FIG. 3.

DETAILED DESCRIPTION OF THE PREFERRED EMBODIMENT

An upper body protector is indicated at 10 in FIG. 1. Typically, it has a front shield 12, a rear shield 14, and an over-the-shoulder portion 16 which connects the other two together. The over-the-shoulder portions defines fixed shoulder pieces 18.

There are also upper arm protective covers 20 which are connected to the rest of the protector or shield by means of a strap, not shown, which is attached to the upper arm protector by a rivet indicated at 22. The upper arm protectors are secured to the arms with velcro straps in most cases.

Because of the loose connection of the upper arm protector to the rest of the shield, it will ride up on the arm with no problem as the arm is raised. However, in the lower position there is a gap between the upper arm protector and the shoulder piece 18 which is an invitation to injury. To eliminate this, these regions are covered by pivotal epaulets 24. The term "epaulet" is generally used for the decorative pieces on the shoulders of military uniforms, etc., but it has come into use in describing these pieces of the torso protectors.

The epaulets are pivoted to the torso protectors as indicated in FIG. 3 by means of a molded plastic pin 26 which extends through a hole in the upper body protector and is heat-stamped at its tip to define a retaining head 28. A metal or nylon washer 30 is put over the pin before it is heat stamped to provide a good rotating surface.

Each of the epaulets utilizes a single hairpin spring 32 which has a crook 34 which passes around the pin 26. The tips of the hair pin springs are bent orthogonally to extend substantially parallel to the axis of motion of the spring, and pass into apertures in bosses 36 in the epaulet and body protector. The tips of course are bent in opposite directions. The minimal clearance between the epaulet and the shield at the pivotal point will not permit the tips of the springs to pop out of the bosses in which they are seated. Further, a relieved area 38 is provided adjacent the crooks of the springs in the material of the body protector portion of the shield. This provides clearance for the spring and also tends to keep it from popping free, although its tips will also serve to insure this.

As can be seen in FIG. 4, as the epaulet moves upwardly and inwardly to the position shown in phantom in FIG. 2, the spring is compressed, exerting and outward/lowered bias, biasing the epaulet into the lower position, indicated in solid in FIG. 2. The raised position is shown in that Figure in phantom.

In order to provide a positive stop at the uppermost limit, when the epaulet is in the raised position, a forward-to-rear rib 40 is provided which provides a stop for the upper edge of the epaulet, again as shown in phantom in FIG. 2. Essentially the same action is provided to define the lower limit of the epaulet by means of the stud projections 42 which catch the flange 44 depending from the upper/inner edge of each of the epaulets.

According to this construction, a potentially dangerous and unsightly strap has been eliminated, and the action of the epaulet has been improved such that it evenly and smoothly rides on, and follows the movement of, the upper arm much more linearly than the previous strap. It provides yet one more step in the advancement of safety and quality in the design of upper chest and torso protector for off-road riders and the like.

In the claims:

1. An upper body protector with spring-biased epaulets comprising:

(a) a protective armor shield for covering at least a portion of the upper body;

(b) a pair of epaulets pivotally attached to said shield on the dorsal and ventral sides thereof and being moveable between a lowered position covering at least a portion of the shoulder articulation to a raised position covering less of the shoulder, to permit raising of the upper arms; and, (c) means actively biasing each of said epaulets from said raised position into said lowered position such that they follow the upper arms down when same are lowered.

2. Structure according to claim 1 wherein said biasing means comprises a hairpin spring having the tip of one leg fastened to the respective epaulet and the tip of the other leg fastened to said shield.

3. Structure according to claim 2 wherein at least one of the pivotal attachments of said epaulets comprises a pivot pin, and said hairpin springs each have a crook engaged around the respective pivot pin.

4. Structure according to claim 3 wherein said shield defines a relieved region around said pivot pins and the crook of said hair pin springs are seated in said relieved portions.

5. Structure according to claim 3 wherein said epaulets are plastic and said pivot pins each comprise a unitary plastic pin extending from said epaulets through apertures in said shield.

6. Structure according to claim 2 wherein the tips of each of said hair pin springs are bent in opposite directions from one another and extend substantially parallel to the axis of the respective springs, and said shield and respective epaulets defined apertured bosses capturing the bent tip of said spring.

7. Structure according to claim 1 wherein said shield includes fixed shoulder pieces over the shoulder alongside the neck, and said raised portion is positively defined by a rib defined by each shoulder piece alongside the neck to provide a stop for the leading edge of the respective epaulet.

8. Structure according to claim 1 wherein said shield includes fixed shoulder pieces over the upper shoulder alongside the neck, and each of said epaulets has a front-to-back depending flange at its upper edge, and said lower position is defined by at least one upward projection defined in the respective shoulder pieces, spaced from the neck, said upward projection and flange positioned such that said flange strikes said upward projection when said epaulet is lowered into its lowered position, to prevent its being lowered further.

9. Structure according to claim 8 wherein said upward projection is plural and is in the form of a row of studs extending front-to-back along said shoulder piece.

10. Structure according to claim 1 wherein said means biasing each epaulet comprises a flat hair pin spring captured between said epaulet and shield and substantially lying in the same plane, to be virtually completely captured and protected from outside interference of passing brush and the like.

* * * * *